US011724309B2

(12) United States Patent
Nishida et al.

(10) Patent No.: US 11,724,309 B2
(45) Date of Patent: Aug. 15, 2023

(54) CASTING FACILITY

(71) Applicants: SINTOKOGIO, LTD., Nagoya (JP); Fujiwa Denki Co., Ltd., Aichi (JP)

(72) Inventors: Tadashi Nishida, Aichi (JP); Toshiyuki Hyodo, Aichi (JP); Masanori Hoshino, Aichi (JP)

(73) Assignees: SINTOKOGIO, LTD., Nagoya (JP); Fujiwa Denki Co., Ltd., Aichi (JP)

( * ) Notice: Subject to any disclaimer, the term of this patent is extended or adjusted under 35 U.S.C. 154(b) by 0 days.

(21) Appl. No.: 17/892,340

(22) Filed: Aug. 22, 2022

(65) Prior Publication Data

US 2023/0068601 A1 Mar. 2, 2023

(30) Foreign Application Priority Data

Aug. 27, 2021 (JP) ..... 2021-139184

(51) Int. Cl.
*B22D 46/00* (2006.01)
*B22D 41/12* (2006.01)

(52) U.S. Cl.
CPC ..... *B22D 46/00* (2013.01); *B22D 41/12* (2013.01)

(58) Field of Classification Search
CPC ..... B22D 46/00; B22D 41/12; B22D 47/00; B22D 47/02; B22D 37/00
See application file for complete search history.

(56) References Cited

U.S. PATENT DOCUMENTS

2020/0009647 A1* 1/2020 Nishida ..... B22D 41/01

FOREIGN PATENT DOCUMENTS

JP 6472899 B2 2/2019
WO WO-2017/085765 A1 5/2017

* cited by examiner

*Primary Examiner* — Kevin P Kerns
*Assistant Examiner* — Steven S Ha
(74) *Attorney, Agent, or Firm* — Faegre Drinker Biddle & Reath LLP

(57) ABSTRACT

Casting facility includes a pouring machine for pouring molten metal in a ladle into a mold molded by a molding machine and conveyed to a pouring site, and the pouring machine includes a plan acquisition unit configured to acquire a planned temperature range of the molten metal for the mold, a temperature sensor configured to detect a temperature of a pouring flow during pouring of the molten metal into the mold, and a temperature determination unit configured to determine whether or not the temperature of the pouring flow is within the planned temperature range, and the pouring machine stops the pouring of the molten metal into the mold when it is determined that the temperature of the pouring flow is not within the planned temperature range.

2 Claims, 7 Drawing Sheets

CASTING FACILITY

CROSS-REFERENCE TO RELATED APPLICATION

This application is based on Japanese Patent Application No. 2021-139184 filed with Japan Patent Office on Aug. 27, 2021, the entire contents of which are hereby incorporated by reference.

TECHNICAL FIELD

The present invention relates to casting facility.

BACKGROUND

Japanese Patent No. 6472899 discloses casting facility. In this casting facility, a ladle receives molten metal in a melting furnace, and conveys the molten metal to a pouring machine. A plurality of molds is molded by a molding machine, and the molds are conveyed one by one to a pouring machine. In the pouring machine, the molten metal in the ladle is poured into the conveyed molds.

SUMMARY

The casting facility described in Japanese Patent No. 6472899 has room to be improved in order to produce better castings. The present disclosure provides casting facility for producing high-quality castings.

Casting facility according to one aspect of the present disclosure includes a pouring machine. The pouring machine pours molten metal in a ladle into a mold which has been molded by a molding machine and conveyed to a pouring site. The pouring machine includes a plan acquisition unit, a temperature sensor, and a temperature determination unit. The plan acquisition unit acquires a planned temperature range of the molten metal for a mold conveyed to a pouring position from the molding machine. The temperature sensor detects the temperature of a pouring flow during pouring of the molten metal into the mold conveyed to the pouring position. The temperature determination unit determines whether or not the temperature of the pouring flow detected by the temperature sensor is within the planned temperature range acquired by the plan acquisition unit. The pouring machine stops the pouring of the molten metal into the mold if it is determined by the temperature determination unit that the temperature of the pouring flow is not within the planned temperature range.

In order to produce a high-quality casting, the molten metal having planned viscosity is required to be poured into a mold. There is a correlation between the temperature of the molten metal and the viscosity of the molten metal. Therefore, in the pouring machine of this casting facility, the pouring machine is controlled based on the temperature of the molten metal. The planned temperature range of the molten metal of the mold conveyed to the pouring position is obtained from the molding machine. The temperature of the pouring flow is detected during pouring of the molten metal into the mold conveyed to the pouring position. When it is determined that the temperature of the pouring flow is not within the planned temperature range, the pouring of the molten metal into the mold is stopped. In this way, the casting facility can avoid that a casting is produced with the molten metal that is not at a planned temperature, that is, the molten metal having no planned viscosity. Therefore, this casting facility can produce a high-quality casting by pouring the molten metal having planned viscosity into a mold.

In one embodiment, the casting facility may further include a conveying device. The conveying device conveys the ladle to the pouring machine. The plan acquisition unit further acquires a planned material number of a mold conveyed to the pouring position, from the molding machine. The pouring machine further includes a material acquisition unit and a material determination unit. The material acquisition unit acquires a material number for identifying the material of the molten metal in the ladle from the conveying device. The material determination unit determines whether or not the planned material number acquired by the plan acquisition unit and the material number acquired by the material acquisition unit match each other. The pouring machine stops pouring of the molten metal into the mold if it is determined by the material determination unit that the planned material number and the material number do not match each other.

In order to produce a high-quality casting, it is necessary that the molten metal having planned components is poured into a mold. Therefore, in the pouring machine of this casting facility, the planned material number of a mold conveyed to a pouring position is obtained from the molding machine. A material number for identifying the material of the molten metal in the ladle is acquired from the conveying device. If it is determined that the planned material number and the material number do not match each other, the pouring of the molten metal into the mold is stopped. In this way, the casting facility can avoid that a casting is produced with the molten metal whose material number is not a planned material number, that is, the molten metal which does not have planned components. Therefore, this casting facility can produce a high-quality casting by pouring the molten metal having planned components into a mold.

In one embodiment, based on information acquired from the molding machine, the plan acquisition unit may further acquire a ladle tilting pattern for the pouring molten metal into the mold conveyed to the pouring position, and a time change of a weight of the ladle when the molten metal is poured according to the ladle tilting pattern. The pouring machine refers to a storage unit in which a correction value for correcting a tilting operation of the ladle is stored, and pours the molten metal into the mold conveyed to the molten-metal conveying position based on the ladle tilting pattern acquired by the plan acquisition unit and the correction value stored in the storage unit. The pouring machine further includes a load cell and an update unit. The load cell measures the weight of the ladle during pouring of the molten metal into the mold conveyed to the pouring position. The update unit updates the correction value stored in the storage unit so that a deviation between the weight of the ladle measured by the load cell and the weight of the ladle at a time of measurement by the load cell acquired by the plan acquisition unit decreases.

In order to produce a high-quality casting, it is necessary that the molten metal is poured into a mold MD with a stable force. In order to pour the molten metal with a stable force, a mechanical operation (ladle tilting pattern) of the pouring machine which is matched with pouring of the molten metal by a skilled operator, and the time change of the weight of the pouring ladle may be stored to reproduce the pouring of the molten metal by the skilled operator. For this reason, in the casting facility, a ladle tilting pattern for pouring the molten metal into a mold conveyed to the pouring position and the time change of the weight of the pouring ladle when the molten metal is poured according to the ladle tilting pattern are further acquired. The storage unit in which a correction value for correcting the tilting operation of the ladle is stored is referred to, and the molten metal is poured into the mold conveyed to the pouring position based on the ladle tilting pattern and the correction value. The weight of the pouring ladle is measured during pouring of the molten metal into the mold. The measured weight of the pouring ladle and the weight of the pouring ladle at a time of measurement by the load cell in the acquired time change of the weight of the pouring ladle are compared with each other, and the correction value stored in the storage unit is updated. In this way, the casting facility can compare the weight of the pouring ladle when the molten metal is poured according to the planned ladle tilting pattern (pouring by a skilled operator) with the result of the weight of the pouring ladle, and give feedback so that next pouring of the molten metal is performed as planned. Therefore, the casting facility can produce a high-quality casting by pouring the molten metal into a mold with a stable force.

According to various aspects and embodiments of the present disclosure, high-quality castings can be produced.

DETAILED DESCRIPTION

Hereinafter, an exemplary embodiment of the present disclosure will be described with reference to the drawings. In the following description, the same signs are given to the same or equivalent elements, and duplicate description thereon will not be repeated.

[Outline of Casting Facility]

Figure 1:
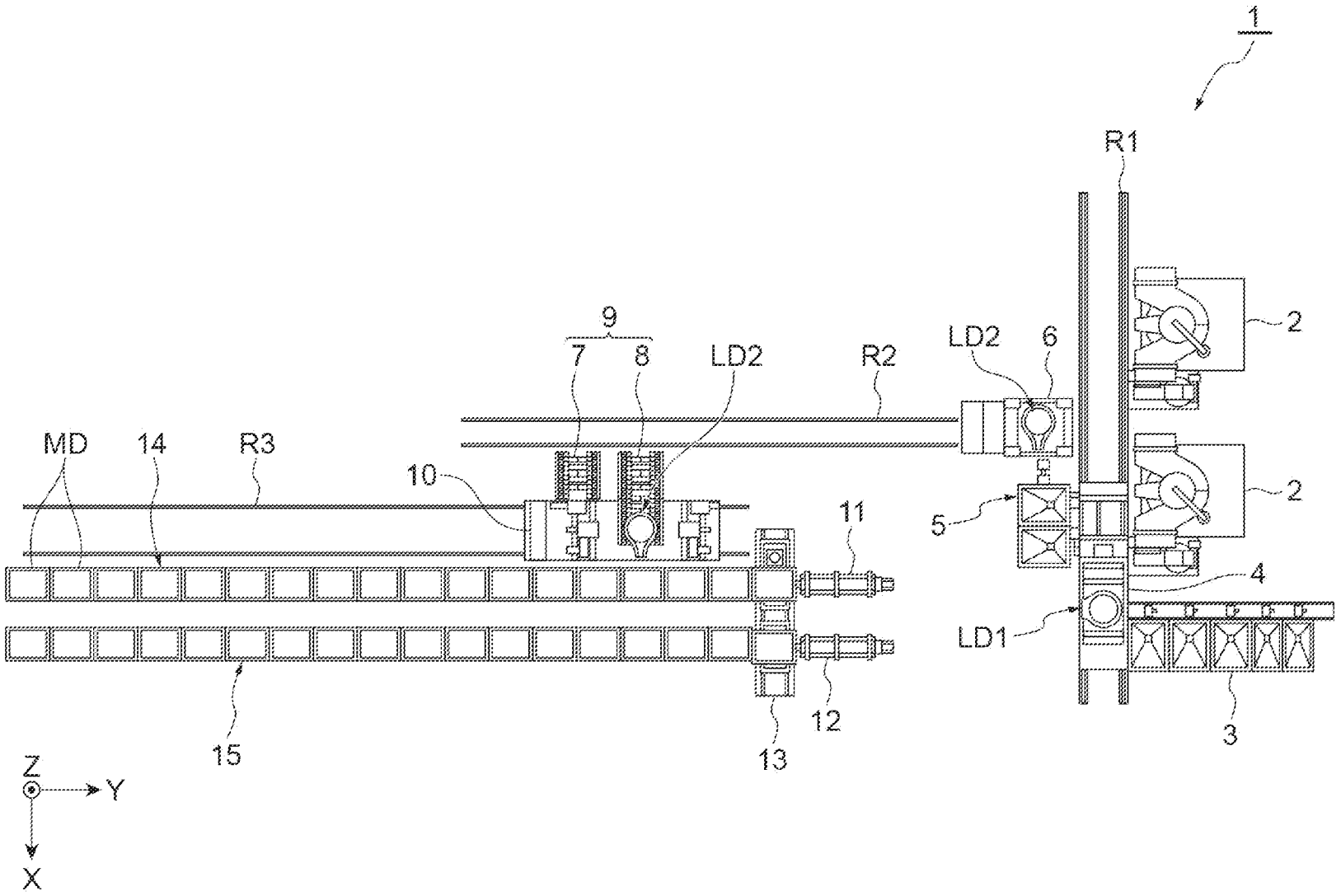
FIG. 1 is a plane view showing a part of casting facility according to an exemplary embodiment.

FIG. 1 is a plane view showing a part of casting facility according to an exemplary embodiment. The casting facility 1 shown in FIG. 1 taps part of raw molten metal obtained at a melting furnace into a ladle, transports the ladle containing the molten metal to a pouring machine, and pours the molten metal in the transported ladle into a mold by using the pouring machine. As shown in FIG. 1, the casting facility 1 includes a melting furnace 2 as an example. The melting furnace 2 melts a melting material with heat to obtain raw molten metal. The melting furnace 2 may be a single melting furnace, or a plurality of melting furnaces. In the example of FIG. 1, two melting furnaces 2 are arranged side by side. A corresponding melting material charging device is juxtaposed with the melting furnace 2, and melting material is charged into the furnace by the melting material charging device. The operations of the melting furnace 2 and the melting material charging device is controlled by a melting block control device 60 (FIG. 5) described later. A temperature sensor is provided in the melting furnace 2. The temperature sensor acquires the temperature of the raw molten metal. The melting furnace 2 can acquire, at a time, the raw molten metal whose amount is sufficient to pour the molten metal into a molten metal reception ladle, described later, at a plurality of times.

The molten metal melted in the melting furnace 2 is tapped into a treatment ladle LD1. The treatment ladle LD1 is placed on a molten metal reception carriage 4, and moves along a molten metal reception carriage rail R1. Before reception of the molten metal, the molten metal reception carriage 4 moves to the position of a primary inoculation device 3 in order to adjust the components of the raw molten metal, and a material for adjusting the components of the raw molten metal is put into the treatment ladle LD1 by the primary inoculation device 3. Thereafter, the molten metal reception carriage 4 moves to a molten-metal receiving position, and the molten metal is tapped from the melting furnace 2 into the treatment ladle LD1. The molten metal reception carriage 4 moves to an emptying position at which the molten metal in the treatment ladle LD1 is emptied into a pouring ladle LD2. The emptying means that the molten metal is transferred to another ladle. When the molten metal is transferred from the treatment ladle LD1 to the pouring ladle LD2, an additive material is put into the pouring ladle LD2 by a secondary inoculation device 5 to adjust the components of the molten metal. The operations of the molten metal reception carriage 4 and the secondary inoculation device 5 are controlled by a molten-metal conveying block control device 50 (FIG. 5) described later.

Figure 5:
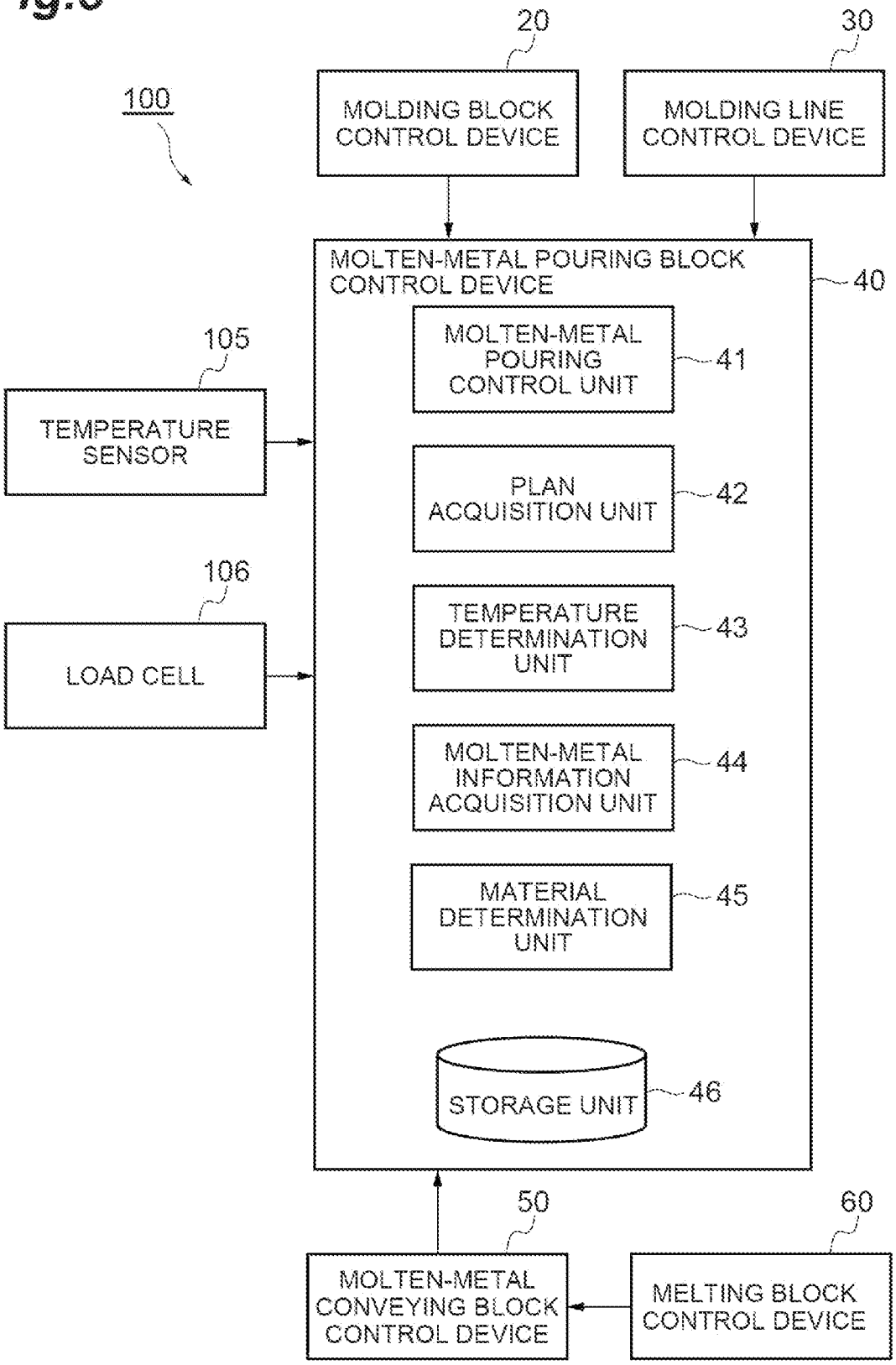
FIG. 5 is a block diagram of a control system of the pouring facility.

The pouring ladle LD2 is placed on a transportation carriage 6, and conveyed along a transportation carriage rail R2. In addition to the above-mentioned emptying position, the transportation carriage 6 can also stop at a ladle exchange position at which the pouring ladle LD2 is conveyed to the pouring machine 10. The operation of the transportation carriage 6 is controlled by the molten-metal conveying block control device 50 (FIG. 5).

The pouring ladle LD2 (full ladle) in which the molten metal is put is delivered from the transportation carriage 6 to a ladle exchange device 9 at a front stage of the pouring machine 10 (the ladle exchange position). In the ladle exchange device 9, the exchange between the actual ladle and a pouring ladle LD2 (empty ladle) which has been emptied due to pouring of the molten metal is implemented. For example, the exchange between the actual ladle and the empty ladle is implemented by sliding the pouring machine 10. For example, the pouring machine 10 slides to a front side of a roller conveyor 8, whereby the empty ladle is delivered from the pouring machine 10 to the roller conveyor 8. The pouring machine 10 slides to a front side of the roller conveyor 7, whereby the actual ladle is delivered from the roller conveyor 7 to the pouring machine 10.

The pouring machine 10 pours the molten metal stored in the pouring ladle LD2 into molds MD. The pouring machine 10 is provided on a side of a pouring zone 14 (an example of the pouring place). In the pouring zone 14, a mold conveying device conveys a plurality of molds MD molded by the molding machine (not shown) one by one with the molds MD being arranged in a row. In the pouring zone 14, the pouring machine 10 pours the molten metal in the pouring ladle LD2 into a mold MD being conveyed.

A rail for the molds MD is laid in the pouring zone 14, and a pair of mold feeding devices 11 (a pusher and a cushion) which correspond to the mold conveying device are arranged at both ends of the rail. The pusher constituting the mold feeding device 11 has a function of pushing out the molds MD, and the cushion constituting the mold feeding device 11 has a function of receiving the molds MD which have been pushed out. The molds MD can be fed out without any gap therebetween by the pusher and the cushion. The mold feeding device 11 feeds out the molds MD one by one. In FIG. 1, only the mold feeding device (cushion) at the front end of the rail is shown, and the illustration of the mold feeding device (pusher) arranged at the rear end of the rail is omitted.

When the molds MD reach the front end of the rail in the pouring zone 14, they are transferred to an adjacent cooling zone 15 by a traverser 13. In the cooling zone, the molds MD are conveyed to a mold disassembling device (not shown) while products after pouring are cooled in the molds MD. A rail for the molds MD is laid in the cooling zone 15, and a pair of mold feeding devices 12 (a pusher and a cushion) are arranged at both ends of the rail as in the pouring zone 14. In FIG. 1, only the mold feeding device (pusher) at the rear end of the rail is shown, and the illustration of the molding feeding device (cushion) arranged at the front end of the rail is omitted. The operation of the mold feeding device 12 is the same as the operation of the mold feeding device 11. The molds MD in the cooling zone 15 are conveyed in a direction opposite to the conveying direction of the molds MD in the pouring zone 14 by the mold feeding device 12. The molds MD into which the molten metal has been poured are cooled on the rail for much time, and the molten metal solidifies into castings before reaching the mold disassembling device. The conveyance of the molds MD is controlled by a molding line control device 30 (FIG. 5) described later. When it is necessary to synchronize the pouring machine 10 and the conveyance of the molds MD, an encoder, a length measuring sensor, or the like is arranged on the rail of the pouring zone 14. The pouring machine 10 is controlled to be synchronized with the conveyance of the molds MD based on the conveying speed and position of the molds MD acquired by using the sensor.

[Details of Pouring Machine]

Figure 2:
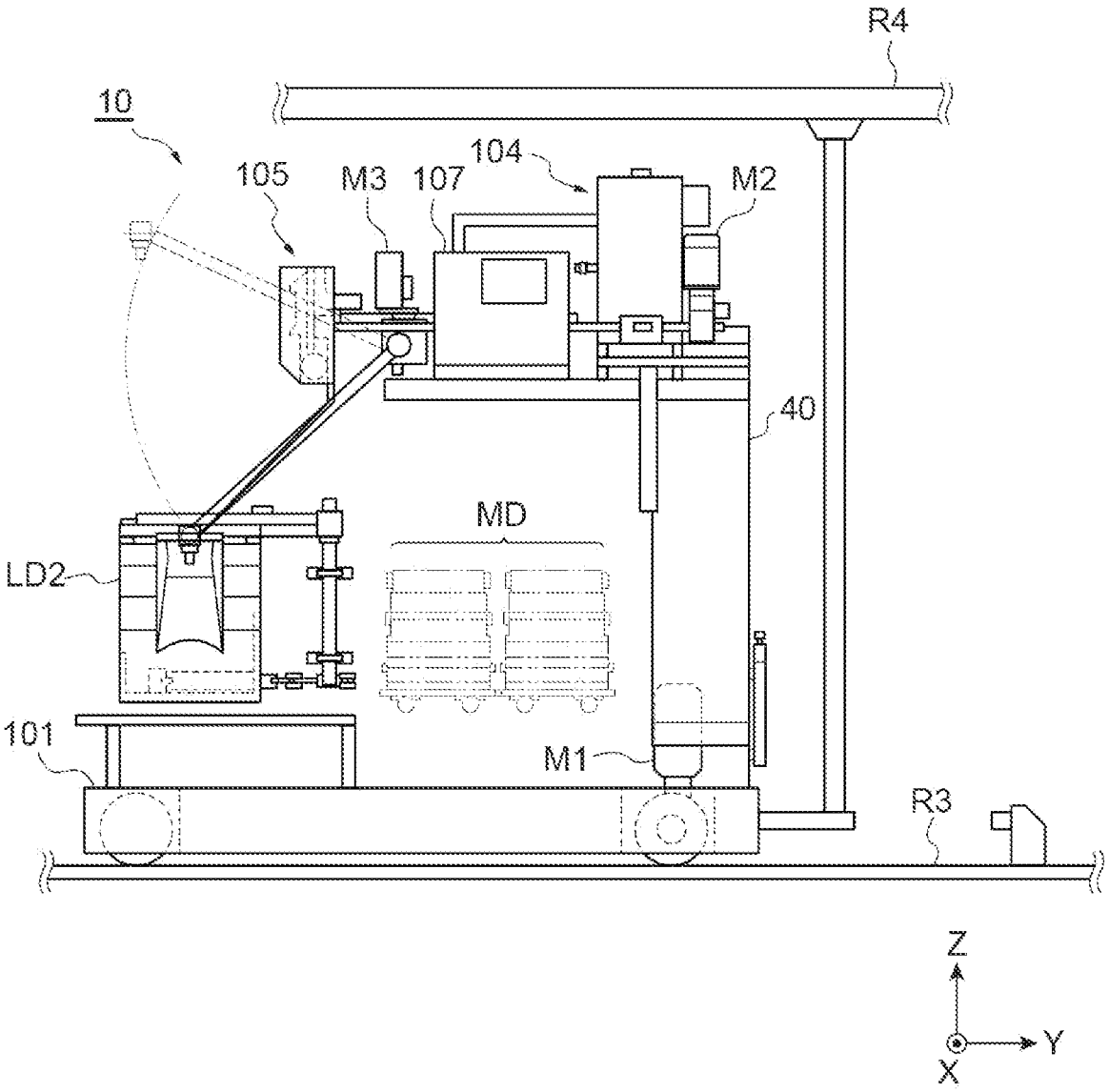
FIG. 2 is a side view of the pouring machine according to the exemplary embodiment.
Figure 3:
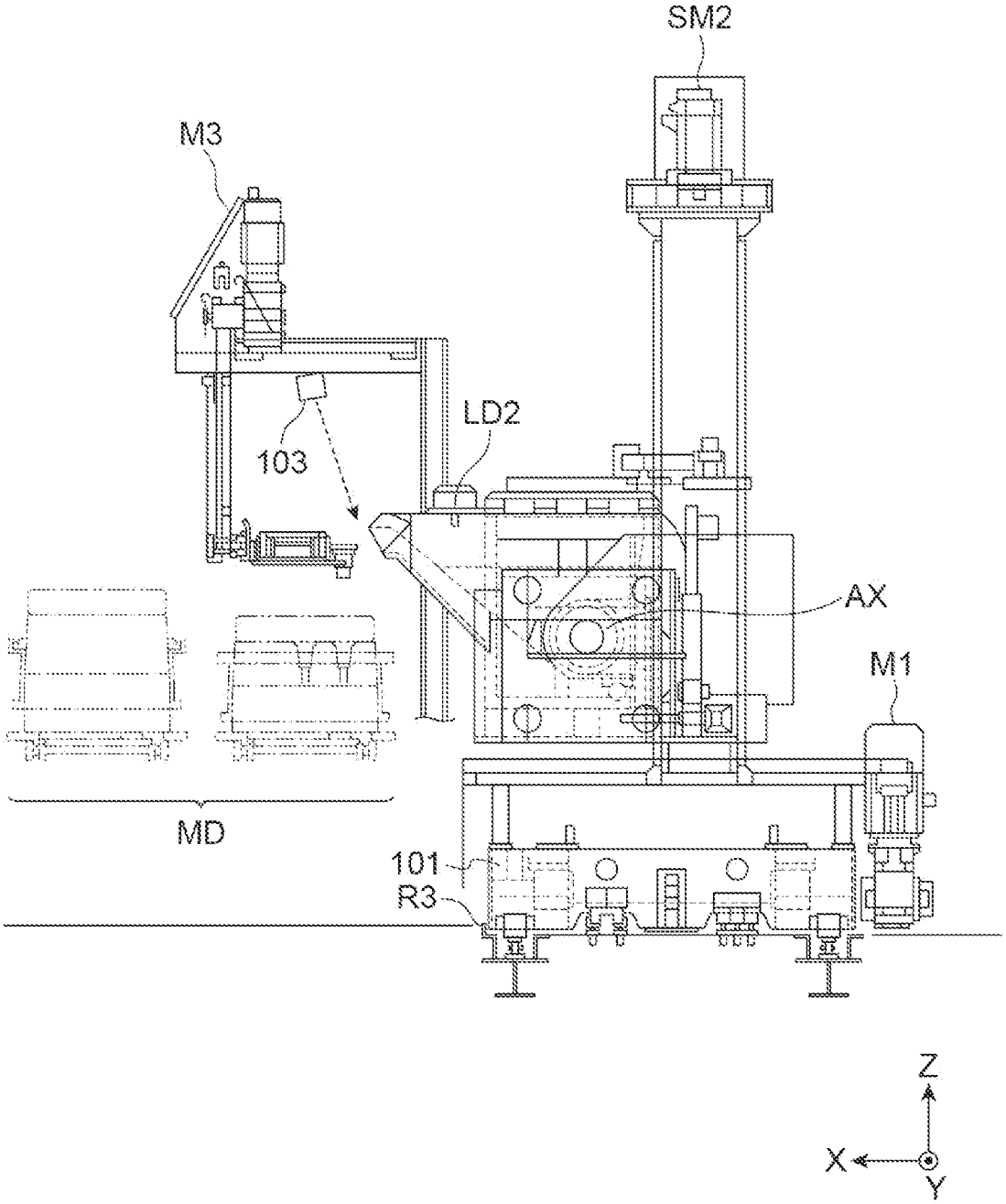
FIG. 3 is a front view of the pouring machine according to the exemplary embodiment.
Figure 4:
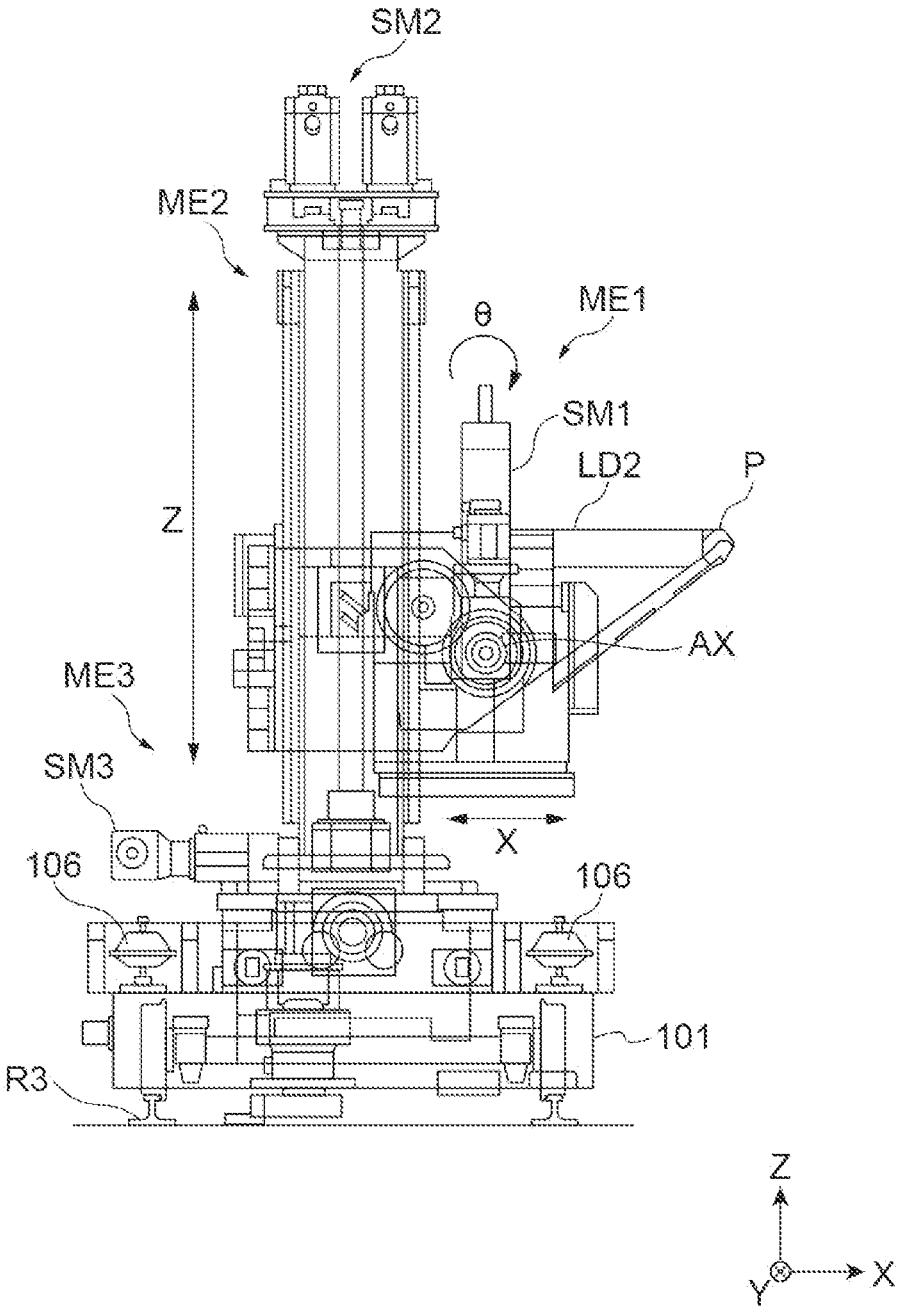
FIG. 4 is a diagram illustrating a shaft configuration of the pouring machine according to the exemplary embodiment.

FIG. 2 is a side view of the pouring machine according to the exemplary embodiment. FIG. 3 is a front view of the pouring machine according to the exemplary embodiment. FIG. 4 is a diagram illustrating a shaft configuration of the pouring machine according to the exemplary embodiment. In FIGS. 2 and 3, the rail for the molds MD is omitted, and only the molds MD is shown.

As shown in FIGS. 2 to 4, the pouring machine 10 includes a pouring carriage 101. The pouring carriage 101 places the pouring ladle LD2 thereon, and travels along a pouring rail R3. A rail R4 for cables is provided in parallel with the pouring rail R3 above the pouring machine 10. A power supply cable and a signal cable are laid on the rail R4 for cables. The power supply cable and the signal cable are connected to the pouring carriage 101 via the rail R4 for cables. As a result, electric power is supplied to the pouring carriage 101 via the power supply cable. Further, communication between the pouring carriage 101 and various devices of the pouring facility can be performed via the signal cable.

The pouring carriage 101 includes a traveling motor M1. The wheels of the pouring carriage 101 are rotated by the drive of the traveling motor M1, and the pouring carriage 101 travels on the pouring rail R3 (the Y direction in the figures). As a result, the pouring ladle LD2 can move along a train of the molds. Further, the pouring ladle LD2 is supported to be tiltable by a tilting mechanism ME1. The tilting mechanism ME1 includes a tilting motor SM1 as a drive source, and tilts the pouring ladle LD2 around a tilting axis K extending in the Y direction in the figures (in a θ direction in the figures). Further, the pouring ladle LD2 is supported to be movable up and down by an elevating mechanism ME2. The elevating mechanism ME2 includes an elevating motor SM2 as a drive source, and moves the tilting mechanism ME1 up and down (a Z direction in the figures). As a result, the pouring ladle LD2 moves up and down together with the tilting mechanism ME1 so that the molten metal can be poured from a predetermined height. Further, the pouring ladle LD2 is supported to be movable by a front-and-rear moving mechanism ME3. The front-and-rear moving mechanism ME3 includes a moving motor SM3 as a drive source, and moves the elevating mechanism ME2 (in the X direction in the figures). As a result, the pouring ladle LD2 can move in such a direction as to approach and leave the molds MD together with the tilting mechanism ME1 and the elevating mechanism ME2. As described above, the pouring ladle LD2 installed in the pouring machine 10 can move to an arbitrary position in the XYZ directions in the figures, and tilt at an arbitrary tilt angle. The molten metal is poured from a tapping point P of the pouring ladle LD2 into the mold MD by the tilting mechanism ME1, the elevating mechanism ME2, and the front-and-rear moving mechanism ME3. The tilting motor SM1, the elevating motor SM2, and the moving motor SM3 are servomotors as an example.

The pouring machine 10 includes a non-contact thermometer 103 (an example of the temperature sensor) for measuring the temperature of the molten metal to be poured. The non-contact thermometer 103 calculates the temperature of the molten metal, for example, by using the amount of two-color infrared radiation detected by a sensor head of a two-color thermometer. The measurement position of the non-contact thermometer 103 is set to be the tapping point P of a nozzle (the tip of the nozzle) of the pouring ladle LD2. As a result, the non-contact thermometer 103 can measure the temperature of the pouring flow.

The pouring machine 10 may include an inoculation device 104. The inoculation device 104 drives a cutting motor M2 so that a screw is operated to cut out a material for adjusting the components of molten metal, and supplies the cut-out material to the pouring flow when the molten metal is poured. As a result, the components of the molten metal are adjusted.

The pouring machine 10 may have a test piece collecting unit 105 for receiving the molten metal for a test piece from the pouring ladle LD2. The test piece collecting unit 105 includes a collecting motor M3 for operating a collecting ladle, and collects a test piece from the molten metal in each pouring ladle LD2 for material inspection.

The pouring machine 10 may have a load cell 106 for measuring the weight of the molten metal in the pouring ladle LD2. The load cell 106 is provided at a position where the weight of the pouring ladle LD2 can be detected (for example, a position where the load on the front-and-rear moving mechanism ME3 is detected). The weight of the molten metal is obtained by subtracting the weight of an empty ladle from the weight of an actual ladle.

The pouring carriage 101 is provided with a molten-metal pouring block control device 40 for controlling the above-mentioned components. The molten-metal pouring block control device 40 controls the above-mentioned components according to preset contents. The molten-metal pouring block control device 40 can also receive an operator's operation by an operation panel 107, and control the above-mentioned components based on the operator's operation.

[Control System for Casting Facility]

FIG. 5 is a block diagram of the pouring facility. As shown in FIG. 5, the control system 100 includes a molding block control device 20, the molding line control device 30, the molten-metal pouring block control device 40, the molten-metal conveying block control device 50, and the melting block control device 60. The device in the figure is configured as a normal computer system comprising PLC or a computer, physically, CPU (Central Processing Unit), main storage devices such as RAM (Random Access Memory) and ROM (Read Only Memory), an input device such as a touch panel or a keyboard, an output device such as a display, an auxiliary storage device such as a hard disk, and the like.

The molding block control device 20 stores a molding plan and operates the molding machine based on the molding plan. The molding plan includes mold information. The mold information is information associated with a mold, and includes a serial number for identifying the mold, information on a model used in the mold (molding model number), a planned casting weight, and the like. The planned casting weight is a preset weight of the molten metal to be poured into the mold.

The molding line control device 30 controls the mold feeding devices 11 and 12, and stores a plurality of conveyance positions fixedly allocated to a train of molds and mold information corresponding to the molds which are located at the conveyance positions, respectively, in association with each other. In short, the mold line control device 30 stores the conveyance position and the mold information in association with each other. The molding line control device 30 updates the mold information associated with each transfer position according to frame feed by the mold feeding devices 11 and 12.

The melting block control device 60 collectively manages information on a melting process. The melting block control device 60 is connected to the melting furnace 2, the melting material charging device, the temperature sensor, and the like. At the time of the first melting of the day, the melting block control device 60 determines a melting material based on a production plan of the day, and causes the melting material charging device to charge the determined melting material. The melting block control device 60 is connected to the molten-metal conveying block control device 50 to exchange information therebetween. The melting block control device 60 acquires information from the melting material charging device, the temperature sensor, and the like, and stores melting information on raw molten metal in each melting furnace 2.

The molten-metal conveying block control device 50 assigns a ladle serial number to a treatment ladle LD1 that receives the raw molten metal. The ladle serial number is a number which is assigned to the ladle and counted up. As an example, the ladle serial number is reset to zero at the start time of casting facility 1 (for example, at the start time of the operation on a day). As an example, the ladle serial number is counted up at the timing when an alloy material for the primary inoculation is poured into the treatment ladle LD1 by the primary inoculation device 3. The ladle serial number is a key code for information retrieval which is linked to primary inoculation, secondary inoculation, molten metal reception information, and the like.

The molten-metal conveying block control device 50 shifts the ladle serial number according to the position of the ladle. For example, the molten-metal conveying control device 51 causes the treatment ladle LD1 on the molten metal reception carriage 4 to take over a ladle serial number assigned in the primary inoculation device 3 at the timing when the molten metal reception carriage 4 departs from the primary inoculation device 3. In response to the transfer from the treatment ladle LD1 to the pouring ladle LD2 (that is, at the timing when the emptying is completed), the molten-metal conveying block control device 50 causes the pouring ladle LD2 on the transportation carriage 6 to take over the serial number of the treatment ladle LD1 on the molten metal reception carriage 4 located at the emptying position.

At the timing when an actual ladle is carried in from the transportation carriage 6 in the roller conveyor 7 of the ladle exchange device 9, the molten-metal conveying block control device 50 causes the ladle serial number of the actual ladle on the transportation carriage 6 to be taken over as the ladle serial number of the actual ladle. The molten-metal conveying block control device 50 outputs the ladle serial number of the actual ladle on the roller conveyor 7 to the molten-metal pouring block control device 40 described later at the time when the actual ladle is moved from the roller conveyor 7 of the ladle exchange device 9 to the pouring machine 10. In this way, the molten-metal conveying block control device 50 shifts the ladle serial number in accordance with the movement of the ladle. The linkage of the ladle serial number with the ladle is released when the ladle has been emptied and receives the molten metal again.

The molten metal conveying block control device 50 stores molten metal reception information. As an example, the molten metal reception information includes the type of the molten metal, a molten metal tapping time, the weight of received the molten metal, the temperature of received the molten metal, a furnace number, a molten metal reception frequency, a melting frequency, an elapsed temperature after reception of the molten metal, and the like. The molten metal reception frequency is a molten-metal replenishing frequency to a ladle. The molten-metal replenishing frequency is expressed with a tapping frequency in the melting furnace, and also expressed with a receiving frequency in the molten metal reception carriage. The molten-metal conveying block control device 50 stores the ladle serial number of the ladle on the molten metal reception carriage 4 and the molten-metal reception information in association with each other. Here, the ladle serial number is associated with the furnace number and the tapping frequency. The molten-metal conveying block control device 50 stores the ladle serial number and each of the furnace number and the tapping frequency in association with each other in response to the tapping of the raw molten metal from the melting furnace 2 to the treatment ladle LD1. The molten-metal conveying block control device 50 acquires the material number from the melting block control device 60, and stores the material number in association with the ladle serial number. The material number is a letter or numeral which is allocated to each material in advance.

The molten-metal pouring block control device 40 is connected to the molding block control device 20, the molding line control device 30, and the molten-metal conveying block control device 50 described above, and is capable of performing mutual communication with them. The non-contact thermometer 103 and the load cell 106 described above are connected to the molten-metal pouring block control device 40, and a measurement result is output to the molten-metal pouring block control device 40. The molten-metal pouring block control device 40 controls the operation of the pouring machine 10. The molten-metal pouring block control device 40 controls the tilting motor SM1, the elevating motor SM2, and the moving motor SM3 to tilt the pouring ladle LD2 around the tapping point P while keeping the position of the tapping point P of the pouring ladle LD2 constant.

The molten-metal pouring block control device 40 includes a molten-metal pouring control unit 41, a plan acquisition unit 42, a temperature determination unit 43, a molten-metal information acquisition unit 44, a material determination unit 45, and a storage unit 46.

The molten-metal pouring control unit 41 controls the operation of the pouring carriage of the pouring machine 10, collects a result of pouring, and stores it as pouring information. The molten-metal pouring control unit 41 stores a plurality of pouring positions and mold information corresponding to molds located at the respective pouring positions respectively while associating the pouring positions with the mold information. The pouring position is a position where the pouring machine 10 pours the molten metal, first pouring at the start of an operation on a day is manually positioned, and subsequent pouring is automatically positioned based on the previous pouring position.

The plan acquisition unit 42 acquires a plurality of conveying positions and mold information corresponding to molds located at the plurality of respective conveying positions from the molding line control device 30. The plan acquisition unit 42 acquires updated information from the molding line control device 30 according to frame feed by the mold feeding devices 11 and 12. As a result, the pouring machine 10 can grasp the mold information of a mold located at each pouring position.

The plan acquisition unit 42 is configured to be capable of referring to a pouring condition preset for each model. The pouring condition is stored in association with the molding model number. The plan acquisition unit 42 grasps the pouring condition for the mold based on the molding model number acquired from the molding line control device 30. The pouring condition include a planned material number (components of the molten metal), a ladle tilting pattern number, a pouring pattern number, a planned temperature range of the molten metal, and the like. The planned material number is a preset material number. The ladle tilting pattern is a pattern indicating the relationship between a mechanical operation (for example, a pouring speed and a tilt angle) and a pouring time (a time change of the mechanical operation). The ladle tilting pattern includes operation data of three axes of a tilt axis for rotation around the tip of the nozzle of the ladle (0 direction in the figure), a front-and-rear axis (X direction in the figure), and an up-and-down axis (Z direction in the figure) for a minute time. The minute time is 0.2 seconds as an example. A ladle tilt pattern number is a letter or numeral assigned to identify the ladle tilting pattern. The pouring pattern is data in which data of the weight of poured the molten metal is added for each data of the above-mentioned ladle tilting pattern. The data of the weight of the poured the molten metal is the weight of the molten metal poured at regular intervals from the start of pouring during tilting. In other words, the pouring pattern is a pattern indicating the relationship between the weight of the poured the molten metal and the molten metal pouring time (the time change of the weight of the ladle). The molten metal pouring pattern number is a letter or numeral assigned to identify the pouring pattern, and the planned pouring pattern number is a preset pouring pattern number.

The temperature determination unit 43 determines the temperature of the molten metal in order to pour the molten metal with expected viscosity. The viscosity of the molten metal decreases depending on the temperature thereof. It is said to be good that the viscosity of the molten metal has the same level as that of water. When the temperature of the molten metal is lower than a planned temperature, it may cause misrun of the molten metal, and conversely, when the temperature of the molten metal is higher than a planned temperature, it causes change in nature. The non-contact thermometer 103 detects the temperature of pouring flow while the molten metal is poured into a mold MD conveyed to a pouring position. The temperature determination unit 43 determines whether or not the temperature of the pouring flow detected by the non-contact thermometer 103 is within a planned temperature range acquired by the plan acquisition unit 42. When it is determined by the temperature determination unit 43 that the temperature of the pouring flow is within the planned temperature range, the molten-metal pouring control unit 41 continues the pouring of the molten metal into the mold MD. When it is determined by the temperature determination unit 43 that the temperature of the pouring flow is not within the planned temperature range, the molten-metal pouring control unit 41 stops the pouring of the molten metal into the mold MD. The pouring ladle LD2 whose pouring of the molten metal is stopped is fed back to the melting place (to return the molten metal). As a result, it is possible to achieve the molten metal pouring with neither misrun of the molten metal nor change in material quality.

The molten-metal information acquisition unit 44 (an example of the material acquisition unit) acquires the molten metal information and stores it in the storage unit 46. When an actual ladle is carried into the pouring machine 10, the molten-metal information acquisition unit 44 acquires the ladle serial number of the actual ladle from the molten-metal conveying block control device 50. The molten metal information is information to be obtained in the pouring step, and examples thereof include a ladle serial number, an elapsed receiving time, a casting weight, a casting time, a material number, a pouring temperature, a fading start time, a test piece serial number, and the like. When the molten metal pouring is completed, the molten-metal information acquisition unit 44 stores the molten metal information in the storage unit 46 with the mold serial number as a basis.

The material determination unit 45 determines the material number in order to pour the molten metal with components as originally planned. The material determination unit 45 determines whether or not the planned material number (mold information) acquired by the plan acquisition unit 42 and the material number (molten metal information) acquired by the molten-metal information acquisition unit 44 match each other. When it is determined by the material determination unit 45 that the planned material number and the material number match each other, the molten-metal pouring control unit 41 continues pouring of the molten metal into the mold MD. When it is determined by the material determination unit 45 that the planned material number and the material number do not match each other, the molten-metal pouring control unit 41 stops pouring of the molten metal into the mold MD. The pouring ladle LD2 for which pouring of the molten metal is stopped is fed back to the melting place (to return the molten metal). The material determination unit 45 may determine at the timing when the actual ladle has arrived at the pouring machine 10. In this case, defective the molten metal is eliminated at an early stage (before pouring of the molten metal).

Figure 6A:
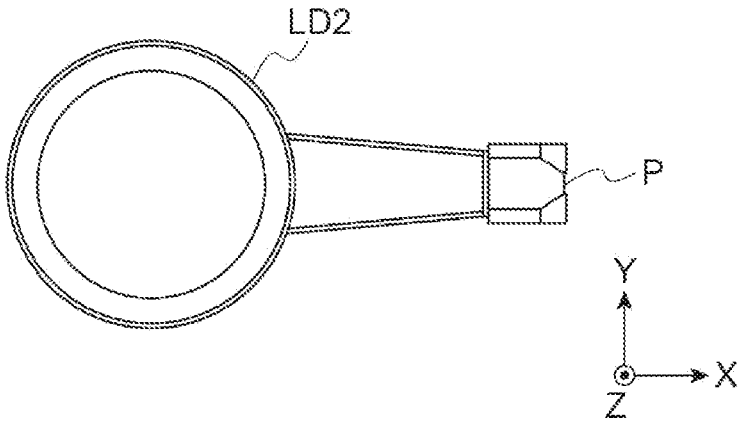
FIG. 6A is a diagram illustrating an outline of a pouring ladle.
Figure 6B:
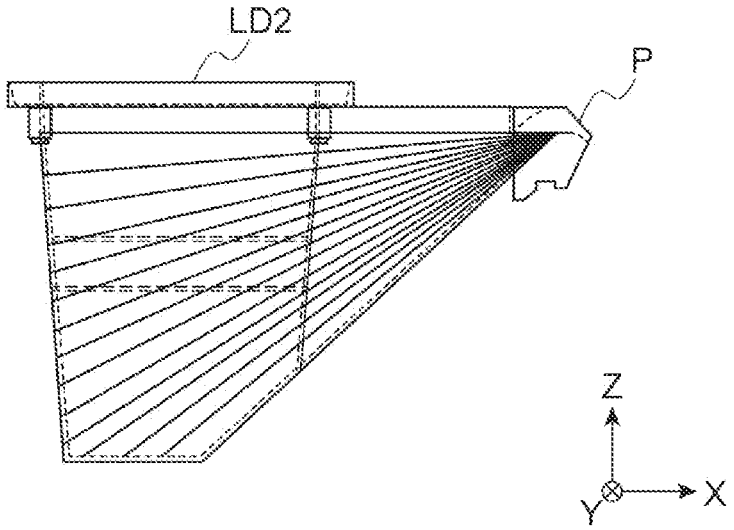
FIG. 6B is a diagram illustrating an outline of a pouring ladle.
Figure 6C:
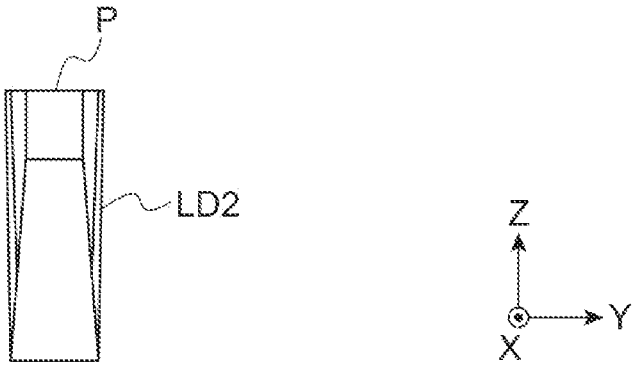
FIG. 6C is a diagram illustrating an outline of a pouring ladle.

In order to pour the molten metal with a stable force, the molten-metal pouring control unit 41 pre-stores a pattern of a mechanical operation and a casting weight (a ladle tilting pattern and a pouring pattern corresponding to the ladle tilting pattern) which is matched with a swallow of the molten metal by an operation of a skilled operator, and causes the stored content to be reproduced. As an example, the molten-metal pouring control unit 41 controls pouring of the molten metal by using the tilting speed of the pouring ladle LD2 as an operation amount. FIGS. 6A to 6C are a diagram illustrating an outline of the pouring ladle. As shown in FIGS. 6A to 6C, an example of the pouring ladle LD2 is a cylindrical ladle. FIG. 6B is a diagram showing the surface position of the molten metal at every 4° tilt angle. As shown in FIG. 6B, in the case of the cylindrical ladle, it can be seen that the surface area of the molten metal changes depending on the tilt angle. In other words, it is shown that the inner capacity of the ladle decreases every pouring and the tapping amount of the molten metal tapped during tilting increases. Therefore, the molten-metal pouring control unit 41 is required to adjust the tapping amount of the molten metal. The molten-metal pouring control unit 41 is set to acquire the shape of the ladle in advance and operate according to the shape.

Figure 7A:
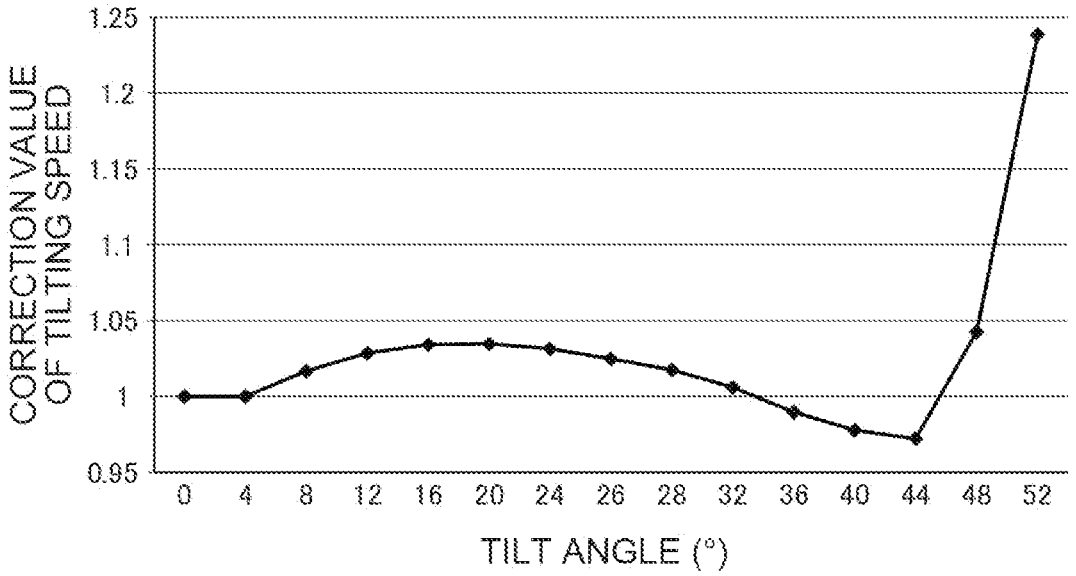
FIG. 7A is a graph showing the relationship between a tilt angle and a correction value of a tilting speed.
Figure 7B:
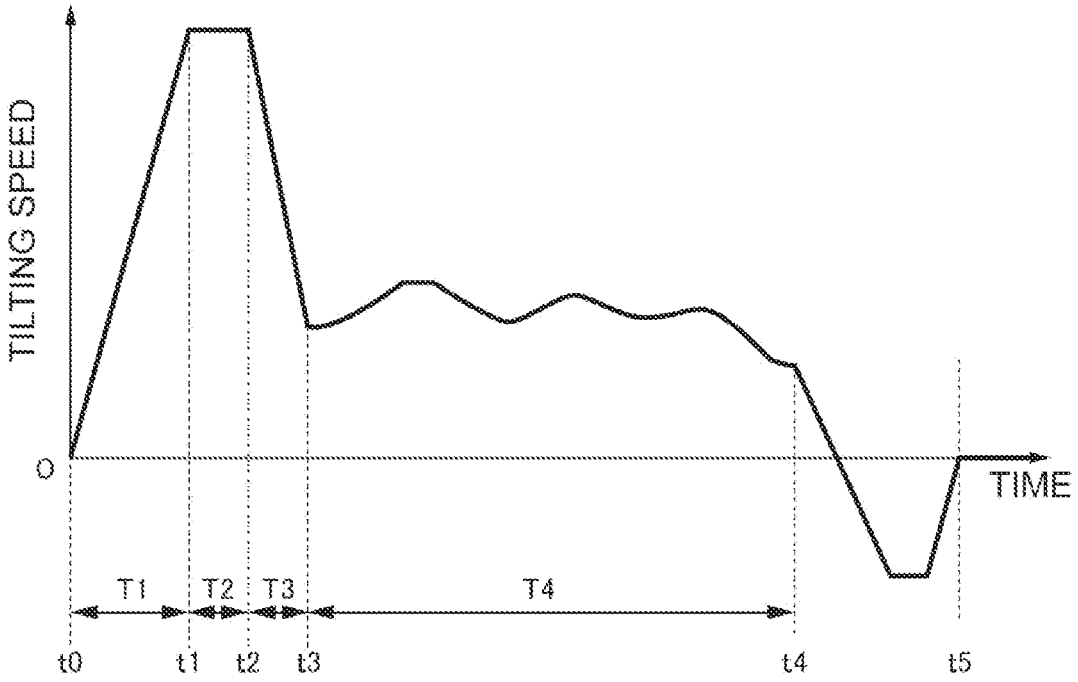
FIG. 7B is a graph showing a time change of the tilting speed.

The storage unit 46 stores a correction value for adjusting the tapping amount of the molten metal described above. FIG. 7A is a graph showing the relationship between the tilt angle and the correction value of the tilting speed. In the graph shown in FIG. 7A, the abscissa represents the tilt angle, and the ordinate represents the correction value of the tilting speed. The correction value of the tilting speed is the reciprocal of a surface area which is calculated with the surface area when the molten metal is filled in a horizontal state being set to 1 at each tilt angle shown in FIG. 6B. The molten-metal pouring control unit 41 refers to the storage unit 46 that has stored correction values, and pours the molten metal into a mold MD conveyed to the pouring position based on a ladle tilting pattern acquired by the plan acquisition unit 42 and a correction value stored in the storage unit 46. FIG. 7B shows a ladle tilting pattern from the start of powering of the molten metal to the drainage of the molten metal, and is a graph showing the time change of the tilting speed. In the graph shown in FIG. 7B, the abscissa represents the time, and the ordinate represents the tilting speed. Time t0 represents a pouring start time, time t1 represents a constant-speed arrival time, time t2 represents a tapping start time, time t3 represents a stability waiting time, time t4 represents a draining time, and time t5 represents a pouring end time. A period T4 from the time t3 to the time t4 is a teaching period in which an expert's experience as described above is needed.

The molten-metal pouring control unit 41 acquires the weight of the pouring ladle LD2 from the load cell 106 during pouring of the molten metal into the mold MD conveyed to the pouring position, and compares the weight of the pouring ladle LD2 measured by the load cell 106 with the weight of the pouring ladle LD2 at a time of measurement by the load cell 106 in the time change of the weight of the pouring ladle LD2 (pouring pattern) acquired by the plan acquisition unit 42. The molten-metal pouring control unit 41 updates the correction value stored in the storage unit 46 so that the weight of the pouring ladle LD2 measured by the load cell 106 and the weight of the pouring ladle LD2 at a time of measurement by the load cell 106 in the molten-metal pouring pattern match each other (so that the deviation therebetween decreases) (an example of the update unit). The correction value for correcting the tilting operation is a value obtained by converting the deviation between the weight of the pouring ladle LD2 acquired by the plan acquisition unit 42 and the weight of the pouring ladle LD2 measured by the load cell 106 into a tilting speed. As a result, the correction value is fed back to the molten-metal pouring control unit 41 so that the molten-metal pouring control unit 41 operates according to a ladle tilting pattern as planned. The correction value for correcting the tilting operation is not limited to the tilting speed, and may be the tilting angle. In this case, the correction value is a value obtained by converting the deviation between the weight of the pouring ladle LD2 acquired by the plan acquisition unit 42 and the weight of the pouring ladle LD2 measured by the load cell 106 into a tilt angle.

Summary of Embodiment

In order to produce high quality castings, it is necessary that the molten metal having planned viscosity is poured into molds MD. The temperature of the molten metal and the viscosity of the molten metal have a correlation therebetween. Therefore, in the pouring machine 10, the pouring machine 10 is controlled based on the temperature of the molten metal. The planned temperature range of the molten metal of the mold MD conveyed to the pouring position is acquired from the molding machine. The temperature of a pouring flow is detected during pouring of the molten metal into the mold MD conveyed to the pouring position. If it is determined that the temperature of the pouring flow is not within the planned temperature range, the pouring of the molten metal into the mold MD is stopped. In this way, the casting facility can avoid production of a casting with the molten metal that is not at a planned temperature, that is, the molten metal that does have viscosity as planned. Therefore, the casting facility can produce a high-quality casting by pouring the molten metal having the planned viscosity into the mold.

In order to produce a high-quality casting, it is necessary that the molten metal having components as planned is poured into a mold MD. Therefore, in the pouring machine 10 of the casting facility, the planned material number of a mold MD which has been conveyed to a pouring position is acquired from the molding machine via the molding line control device 30. A material number for identifying the material of the molten metal in the pouring ladle LD2 is acquired from the molten-metal conveying block control device 50. When it is determined that the planned material number and the material number do not match each other, the pouring of the molten metal into the mold MD is stopped. In this way, the casting facility can avoid production of a casting with the molten metal whose material number is not a material number as planned, that is, the molten metal whose components are not components as planned. Therefore, the casting facility can produce a high-quality casting by pouring the molten metal having components as planned into a mold MD.

In order to produce a high-quality casting, it is necessary that the molten metal is poured into a mold MD with a stable force. In order to pour the molten metal with a stable force, a mechanical operation (ladle tilting pattern) of the pouring machine 10 which is matched with pouring of the molten metal by a skilled operator, and the time change of the weight of the pouring ladle LD2 may be stored to reproduce the pouring of the molten metal by the skilled operator. For this reason, in the casting facility, a ladle tilting pattern for pouring the molten metal into a mold MD conveyed to the pouring position and the time change of the weight of the pouring ladle LD2 when the molten metal is poured according to the ladle tilting pattern are further acquired. The storage unit 46 in which a correction value for correcting the tilting operation of the ladle is stored is referred to, and the molten metal is poured into the mold MD conveyed to the pouring position based on the ladle tilting pattern and the correction value. The weight of the pouring ladle LD2 is measured during pouring of the molten metal into the mold MD. The measured weight of the pouring ladle LD2 and the weight of the pouring ladle LD2 at the measurement time by the load cell 106 in the acquired time change of the weight of the pouring ladle LD2 are compared with each other, and the correction value stored in the storage unit 46 is updated. In this way, the casting facility can compare the weight of the pouring ladle LD2 when the molten metal is poured according to the planned ladle tilting pattern (pouring by a skilled operator) with the result of the weight of the pouring ladle LD2, and give feedback so that next pouring of the molten metal is performed as planned. Therefore, the casting facility can produce a high-quality casting by pouring the molten metal into a mold MD with a stable force.

Although various exemplary embodiments have been described above, various omissions, substitutions, and changes may be made without being limited to the above-mentioned exemplary embodiment. For example, the determination to stop pouring of the molten metal may be performed before the pouring ladle LD2 is conveyed to the pouring machine 10. For example, in the conveying device, the ladle exchange device or the like, the comparison between the planned temperature and the measured temperature of the molten metal and the comparison between the planned material number and the material number of the molten metal may be performed. As a result, it can be avoided that defective the molten metal is loaded on the pouring machine 10.

REFERENCE SIGNS LIST

1 . . . casting facility, 2 . . . melting furnace, 3 . . . primary inoculation device, 4 . . . molten metal reception carriage, 5 . . . secondary inoculation device, 6 . . . transportation carriage, 9 . . . ladle exchange device, 10 . . . pouring machine, 40 . . . molten-metal pouring block control device, 41 . . . molten-metal pouring control unit (an example of update unit), 42 . . . plan acquisition unit, 43 . . . temperature determination unit, 44 . . . molten-metal information acquisition unit (an example of material acquisition unit), 45 . . . material determination unit, 46 . . . storage unit, 103 . . . non-contact thermometer (an example of temperature sensor), 106 . . . load cell.

What is claimed is:

1. Casting facility comprising:

a pouring machine configured to pour molten metal in a ladle into a mold molded by a molding machine and conveyed to a pouring position; and a conveying device configured to convey the ladle to the pouring machine, wherein the pouring machine comprises:

a plan acquisition unit configured to acquire a planned temperature range of the molten metal for the mold conveyed to the pouring position and a planned material number of the mold conveyed to the pouring position, from the molding machine;

a temperature sensor configured to detect a temperature of a pouring flow during pouring of the molten metal into the mold conveyed to the pouring position;

a temperature determination unit configured to determine whether or not the temperature of the pouring flow detected by the temperature sensor is within the planned temperature range acquired by the plan acquisition unit;

a material acquisition unit configured to acquire a material number for identifying a material of the molten metal in the ladle from the conveying device; and a material determination unit configured to determine whether or not the planned material number acquired by the plan acquisition unit and the material number acquired by the material acquisition unit match each other, and wherein the pouring machine stops the pouring of the molten metal into the mold when it is determined by the temperature determination unit that the temperature of the pouring flow is not within the planned temperature range, and the pouring machine stops the pouring of the molten metal into the mold when it is determined by the material determination unit that the planned material number and the material number do not match each other.

2. The casting facility according to claim 1, wherein based on information acquired from the molding machine, the plan acquisition unit further acquires a ladle tilting pattern for pouring the molten metal into the mold conveyed to the pouring position, and a time change of a weight of the ladle when the molten metal is poured according to the ladle tilting pattern, wherein the pouring machine refers to a storage unit in which a correction value for correcting a tilting operation of the ladle is stored, and pours the molten metal into the mold conveyed to the pouring position based on the ladle tilting pattern acquired by the plan acquisition unit and the correction value stored in the storage unit, wherein the pouring machine further comprises:

a load cell configured to measure the weight of the ladle during pouring of the molten metal into the mold conveyed to the pouring position; and an update unit configured to update the correction value stored in the storage unit so that a deviation between the weight of the ladle measured by the load cell, and a weight of the ladle at a time of measurement by the load cell, which is defined from the time change of the weight of the ladle acquired by the plan acquisition unit decreases.

* * * * *